US008646771B2

(12) United States Patent
Youn

(10) Patent No.: US 8,646,771 B2
(45) Date of Patent: Feb. 11, 2014

(54) IMAGE FORMING APPARATUS

(75) Inventor: Chang Min Youn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 343 days.

(21) Appl. No.: 12/923,222

(22) Filed: Sep. 9, 2010

(65) Prior Publication Data

US 2011/0064508 A1 Mar. 17, 2011

(30) Foreign Application Priority Data

Sep. 14, 2009 (KR) ..... 10-2009-0086369

(51) Int. Cl.
*B65H 1/00* (2006.01)
*B65H 3/06* (2006.01)

(52) U.S. Cl.
USPC ..... 271/162; 271/164; 271/117; 271/145

(58) Field of Classification Search
USPC ..... 271/162, 164, 160, 117, 157
See application file for complete search history.

(56) References Cited

U.S. PATENT DOCUMENTS 5,501,444 A * 3/1996 Yukimachi et al. ..... 271/127
2010/0301543 A1* 12/2010 Ueyama et al. ..... 271/117

FOREIGN PATENT DOCUMENTS

JP 57166236 A * 10/1982
JP 59017431 A * 1/1984
JP 62079140 A * 4/1987
JP 04333435 A * 11/1992

* cited by examiner

*Primary Examiner* — Luis A Gonzalez
(74) *Attorney, Agent, or Firm* — Staas & Halsey LLP

(57) ABSTRACT

Disclosed is an image forming apparatus in which a pickup unit is arranged to be movable in association with the detaching/mounting movement of a detachable printing medium cassette. With such a movement of the pickup unit, it is possible to increase the number of printing media that can be stored in the printing medium cassette having a predetermined height.

12 Claims, 6 Drawing Sheets

IMAGE FORMING APPARATUS

CROSS-REFERENCE TO RELATED APPLICATION

This application claims the benefit of Korean Patent Application No. 2009-0086369, filed on Sep. 14, 2009 in the Korean Intellectual Property Office, the disclosure of which in its entirety is incorporated herein by reference.

TECHNICAL FIELD

The present disclosure relates generally to an image forming apparatus having a pickup unit to pick up a printing medium from a printing medium cassette in which a plurality of printing media is stored.

BACKGROUND OF RELATED ART

Image forming apparatuses are devised to form an image on a printing medium according to received image signals. Examples of image forming apparatuses include printers, copiers, facsimiles and multi-functional devices that combines the functions of several of aforementioned devices.

An image forming apparatus includes, e.g., a body defining the overall outer appearance of the image forming apparatus, a printing medium cassette in which printing media is stored, the printing medium cassette typically being received in the lower region of the body as a slidable drawer, a developing unit that forms a visible image on a printing medium using developer, a pickup unit that picks up and delivers a printing medium from the printing medium cassette to the developing unit, a fusing unit that fixes the developer forming the visible image onto the printing medium and a discharge unit that discharge the printing medium bearing the completed image out of the body.

The printing medium cassette includes a knock-up plate on which the printing media is loaded, an elastic supporting spring that elastically biases the knock-up plate upward and a supporting guide that guides an end of each printing medium loaded on the knock-up plate.

The pickup unit also includes a pickup roller that picks up the printing media loaded on the knock-up plate sheet by sheet, and which, to that end, is arranged to protrude downward so as to come into contact with the upper surface of the uppermost one of the printing media loaded on the knock-up plate.

With such configuration, the downwardly protruding pickup roller may interfere with the movement of the supporting guide when the printing medium cassette is detached and separated from the body of the image forming apparatus. It may thus be necessary to position the upper end of the supporting guide at a height that is lower than the position of the pickup roller so as to prevent the supporting guide from being caught by the pickup roller. Such lowered height of the supporting guide may unfortunately limit the number of printing media that can be loaded in the printing medium cassette.

SUMMARY OF DISCLOSURE

In accordance with one aspect of the present disclosure, an image forming apparatus may be provided to include a body, a printing medium cassette and a pickup unit. The printing medium cassette may be detachably received in the body, and may be movable along a movement path into and out of the body. The pickup unit may be configured pick up a printing medium from the printing medium cassette, and may be movable out of the movement path of the printing medium cassette in cooperation with a detaching movement of the printing medium cassette along the movement path out of the body.

The image forming apparatus may further comprise an operating lever arranged to be rotatable about one end thereof and a pivoting spring. The operating lever may be configured to rotate in a first direction in an interfering contact with the pickup unit so as to cause the pickup unit to move out of the movement path of the printing medium cassette. The pivoting spring may elastically bias the operating lever to rotate in the first direction.

The operating lever may comprise a link member arranged to come into an interfering contact with a stopper provided on the printing medium cassette. The interfering contact between the link member and the stopper may allow the operating lever to rotate in the second direction opposite the first direction according to the movement of the printing medium cassette along the movement path into the body.

The pickup unit may include a pickup roller, a delivery roller and a pickup frame. The pickup roller may be configured to pick up the printing medium. The delivery roller may be configured to deliver the picked up printing medium away from the printing medium cassette. The pickup roller and the delivery roller may be rotatably coupled to the pickup frame. The pickup frame may have a transmitter in the form of an extension that receives the force from the operating lever so as to cause the pickup unit to move.

The pickup unit may further comprise a pickup shaft. The pickup roller may be arranged to rotate about a pickup roller shaft that is parallel to the pickup shaft, and may be moveable circumferentially about the pickup shaft out of the movement path of the printing medium cassette.

The printing medium cassette may include a knock-up plate, on which the printing medium is loaded, and a supporting guide arranged to support one end of the printing medium loaded on the knock-up plate. The pickup roller may be movable to a position higher than an upper end of the supporting guide.

The image forming apparatus may further comprise a moving guide installed on at least one of opposing sides of the printing medium cassette to guide the movement of the printing medium cassette along the movement path. The operating lever and the pivoting spring may be arranged on the moving guide.

The moving guide may have an arcuate shape guide slot into which a portion of the operating lever is movably received.

According to another aspect of the present disclosure, an image forming apparatus may be provided to include a body, a printing medium cassette, a supporting guide and a pickup roller. The printing medium cassette may be movably received in the body so as to be detachable from the body via movement thereof. The supporting guide may be arranged in the printing medium cassette to support one end of a printing medium. The pickup roller may be configured to pick up the printing medium from the printing medium cassette. The pickup roller may be moveable to a position that is higher than an upper end of the supporting guide as the printing medium cassette moves to be detached from the body.

The image forming apparatus may further comprise an operating lever arranged to be rotatable about one end thereof, a pivoting spring to elastically support the operating lever to be rotate in a first direction and a pickup frame, one side of which is rotatably coupled to the body and the other side of which is provided with the pickup roller. The pickup frame may have a transmitter configured to receive force transmitted from the other end of the operating lever when the operating lever rotates in the first direction so as to allow the pickup frame rotate upon receiving the force through the transmitter.

The operating lever may comprise a link member arranged to come into an interfering contact with a stopper provided on the printing medium cassette. The interfering contact between the link member and the stopper may allow the operating lever to rotate in the second direction opposite the first direction according to movement of the printing medium cassette.

According to yet another aspect of the present disclosure, an image forming apparatus may be provided a body, a printing medium cassette, a pickup unit, a supporting guide, an operating lever and a pivoting spring. The printing medium cassette may be movably received in the body so as to be separable from the body via movement thereof. The pickup unit may be configured to pick up a printing medium from the printing medium cassette. The supporting guide may be arranged in the printing medium cassette to support one end of the printing medium in the printing medium cassette. The operating lever may be rotatable in a first direction as the printing medium cassette moves to be separated from the body to thereby rotate the pickup unit to a position higher than an upper end of the supporting guide. The pivoting spring may be configured to elastically support the operating lever to rotate in the first direction.

The pickup unit may include a pickup roller that may be configured to pick up the printing medium, and that may be movable to a position higher than the upper end of the supporting guide according to the rotational movement of the pickup unit.

The printing medium cassette may have a stopper that is configured to interfere with the operating lever so as to cause the operating lever to rotate in a second direction opposite the first direction as the printing medium cassette moves into the body.

The operating lever may have a link member adapted to come into an interfering contact with the stopper to thereby allow the operating lever to operate in linkage with the printing medium cassette.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
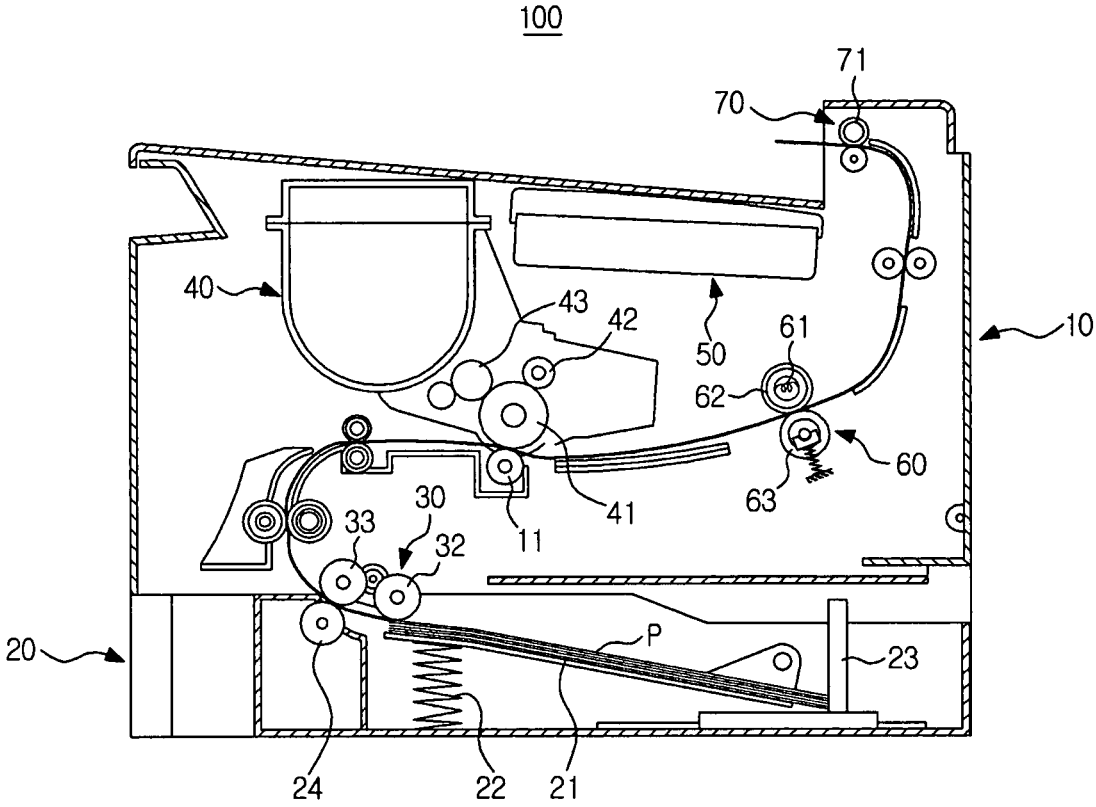
FIG. 1 is a sectional schematic of an illustrative configuration of an image forming apparatus according to an embodiment of the present disclosure.

Reference will now be made in detail to the embodiments of the present disclosure, examples of which are illustrated in the accompanying drawings, wherein like reference numerals refer to the like elements throughout.

As illustrated in FIG. 1, an image forming apparatus 100 according to an embodiment of the present disclosure may include a body 10 defining the overall outer appearance of the image forming apparatus 100, a printing medium cassette 20, a pickup unit 30, a developing unit 40, an exposure unit 50, a fusing unit 60 and a discharge unit 70. The printing medium cassette 20, in which a plurality of printing media P is stored, is separably or detachably received in the body 10, and, to that end, is movable along the mounting direction into and away from the body 10. The printing medium cassette 20 serves to accommodate the printing media P that are to be supplied to the developing unit 40. The pickup unit 30 is used to pick up the printing media P stored in the printing medium cassette 20 sheet by sheet. The developing unit 40 serves to form a visible developer image on each printing medium P supplied via the pickup unit 30. The exposure unit 50 serves to form an electrostatic latent image on a photosensitive body 41 of the developing unit 40. The fusing unit 60 serves to fuse the developer being carried on the printing medium P permanently onto the printing medium P. The discharge unit 70 serves to discharge the printing medium P bearing a developer image fused thereon out of the body 10.

The printing medium cassette 20 according to an embodiment may include a knock-up plate 21 on which the printing media P is loaded, an elastic supporting spring 22 arranged beneath an end of the knock-up plate 21 to elastically support and push the end of the knock-up plate 21 upward, a supporting guide 23 at the other end of the knock-up plate 21 to support ends of the printing media P loaded on the knock-up plate 21 and a reverse roller 24 arranged to face the pickup unit 30 to minimize the simultaneous feeding of multiple printing media P. A pair of moving guides 14 (see FIG. 2) may be provided in the body 10 to guide the mounting or detaching movement of the printing medium cassette 20. According to an embodiment, both lateral ends of the printing medium cassette 20 may be supported by the two moving guides 14 to thereby enable the sliding movement of the printing medium cassette 20.

The developing unit 40 forms a visible image on the printing medium P delivered from the printing medium cassette 20 by the use of developer. To that end, the developing unit 40 may include a photosensitive body 41 having a photosensitive surface capable of being charged by charging device, for example, a charging roller 42 to certain electrical potential. So charged photosensitive surface of the photosensitive body 41 may be exposed to light received from the exposure unit 50 to thereby form an electrostatic latent image as a pattern of electrical potential differences between the exposed and unexposed portions of the photosensitive surface. The developing unit 40 may further include a developing roller 43 that operates to develop the electrostatic latent image formed on the photosensitive body 41 into a visible developer image by applying developer to the electrostatic image. A transfer roller 11 may be provided in pressing and opposingly facing arrangement with the photosensitive body 41 so as to allow the printing medium P to be pressed toward the photosensitive body 41 and to thereby allow the transfer of the visible developer image from the photosensitive body 41 to the printing medium P.

The exposure unit 50 irradiates light that is modulated with information relating to the desired image be formed information on the photosensitive body 41 to thereby cause the electrostatic latent image to be formed on the photosensitive body 41.

The fusing unit 60 fuses the developer image onto the printing medium P by applying heat and/or pressure to the printing medium P. To that end, the fusing unit 60 may include a heating roller 62 in which a heater 61 is received and a press roller 63 to press the printing medium P toward the heating roller 62. As the heat and pressure is applied to the printing medium P passing between the heating roller 62 and the press roller 63, the visible developer image previously transferred to and being carried on the printing medium P is permanently fused onto the printing medium P.

The discharge unit 70 may include discharge roller(s) 71, which may be arranged in succession, and operates to discharge the printing medium P, which has passed through the fusing unit 60, outside the body 10.

Figure 2:
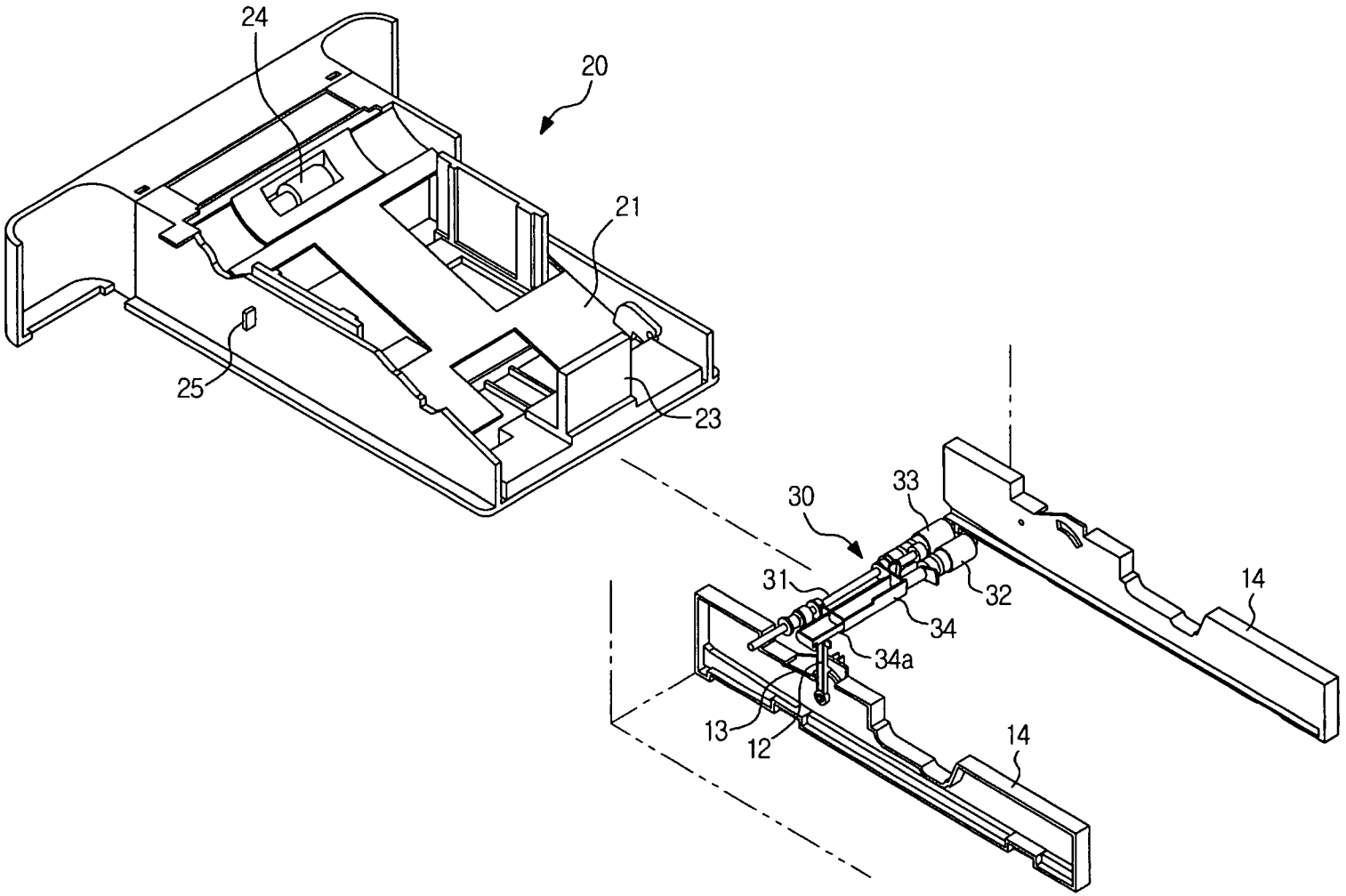
FIG. 2 is a perspective view of a pickup unit and a printing medium cassette of an image forming apparatus according to an embodiment of the present disclosure.

The pickup unit 30, according to an embodiment shown in FIG. 2, is adapted to pick up the uppermost one of the printing media P stored in the printing medium cassette 20, and to deliver the picked up printing media P to the developing unit 40 one sheet at a time. The pickup unit 30 according to an embodiment may include a pickup shaft 31 for transmission of rotation force, a pickup roller 32 configured to pick up the uppermost printing medium P loaded on the knock-up plate 21 via rotation thereof, a delivery roller 33 configured to deliver the printing medium P picked up by the pickup roller 32 to the developing unit 40 along a delivery path defined in the body 10 and a pickup frame 34 to which the pickup roller 32 and the delivery roller 33 are rotatably coupled. In this example, the pickup roller 32 and the delivery roller 33 are rotated upon receiving rotation force transmitted via the pickup shaft 31 to thereby pick up and deliver the printing medium P.

Figure 3:
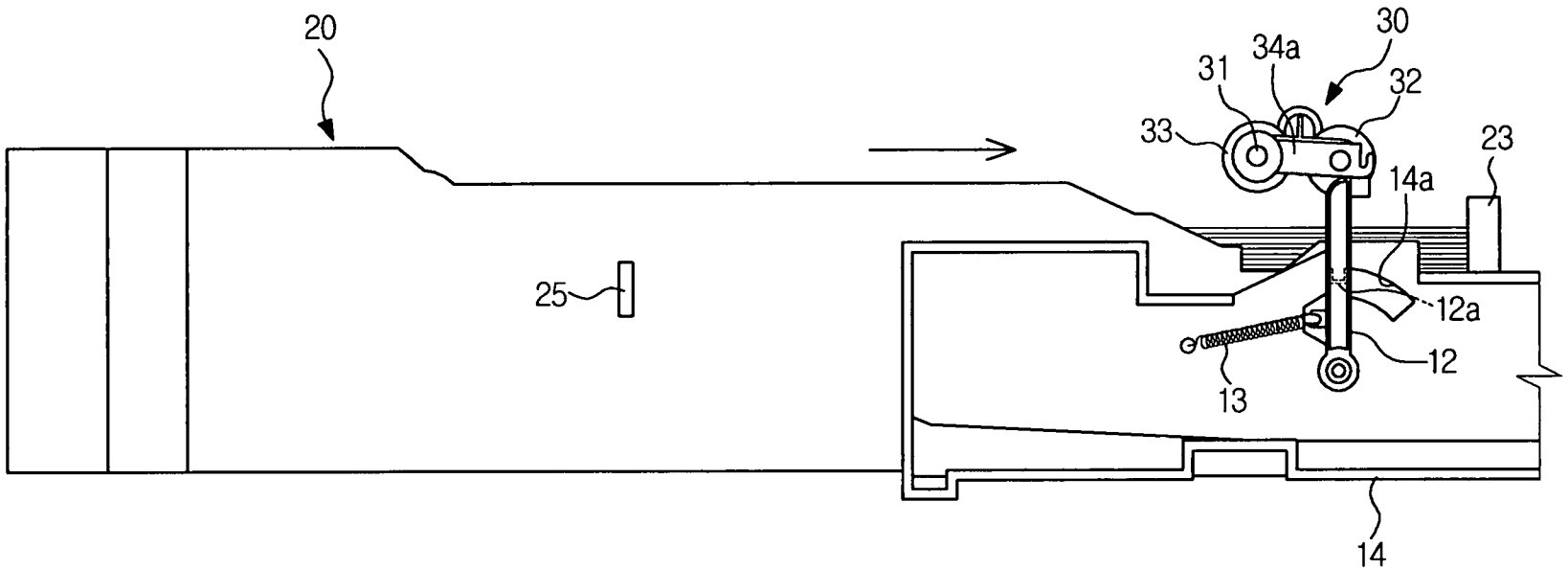
FIG. 3 is a side view illustrative of coupling and/or separation of the printing medium cassette to and from an image forming apparatus according to an embodiment of the present disclosure.
Figure 4:
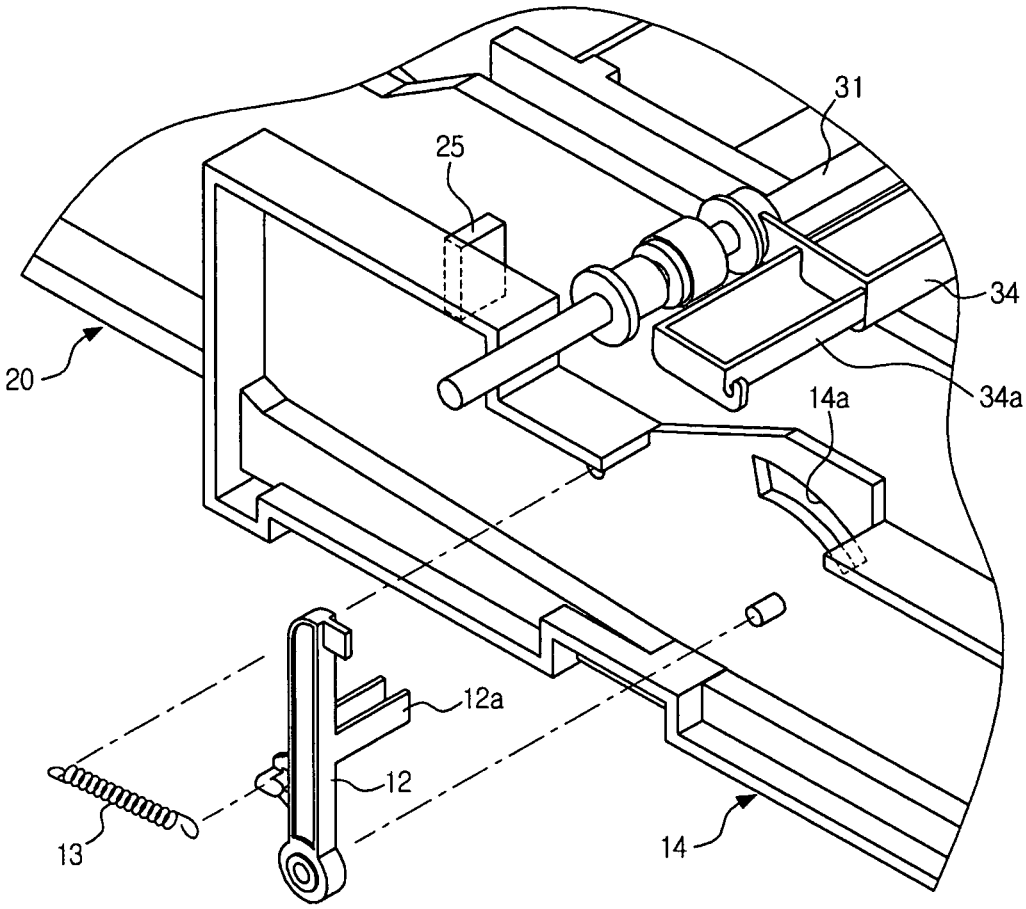
FIG. 4 is an exploded perspective view illustrating an installation configuration of an operating lever and a return spring provided in an image forming apparatus according to an embodiment of the present disclosure.

As shown in FIGS. 3 and 4, the delivery roller 33 of the pickup unit 30 is arranged to partially protrude into the movement path of the printing medium cassette 2, thus serving to feed the printing medium P loaded on the knock-up plate 21. As the printing medium cassette 20 becomes separated from the body 10 however, the delivery roller 33 is arranged so that it moves out of the movement path of the printing medium cassette 20. This movement of the delivery roller 33 may prevent the interference between the printing medium cassette 20 and the pickup unit 30 when the printing medium cassette 20 is separated from the body 10.

According to an embodiment of the present disclosure, and with the above mentioned configuration of the pickup unit 30, the pickup roller 32 is adapted to protrude downward so as to be capable of picking up the printing medium P stored in the printing medium cassette 20. That is, according to an embodiment, as the pickup frame 34 rotates forward or backward about the pickup shaft 31 in a state wherein one side of the pickup frame 34 is rotatably coupled to the body 10 via the pickup shaft 31 and the other side of the pickup frame 34 is provided with the pickup roller 32, the pickup roller 32 may be arranged to move along a circumferential movement path downward toward the pickup shaft 31 or upward or outward away from the printing medium cassette 20 according to the rotational movement of the pickup frame 34 about the pickup shaft 31. With such an arrangement, even with the supporting guide 23 extending upward from the printing medium cassette 20, the pickup roller 32 may be moved to a position that is higher than the upper end of the supporting guide 23 as the printing medium cassette 20 is being separated from the body 10.

Allowing the pickup roller 32 to move out of the movement path of the printing medium cassette 20 as the printing medium cassette 20 is separated from the body 10 may prevent the interference between the supporting guide 23 and the pickup roller 32 even if the supporting guide 23 has the same height as that of the printing medium cassette 20. Accordingly, it may be possible to increase the height of the supporting guide 23 to a level substantially equal to that of the printing medium cassette 20. Since the storage amount of printing media P in the printing medium cassette 20 can be increased in proportion to the height of the supporting guide 23, it may be possible to maximize the number of printing media P that can be stored in the printing medium cassette 20 having a predetermined height.

To allow the pickup unit 30 to move out of the movement path of the printing medium cassette 20, the image forming apparatus 100 according to an embodiment may include an operating lever 12 arrange to force the movement of the pickup unit 30 and a pivoting spring 13 arranged to elastically bias the rotational movement of the operating lever 12.

According to an embodiment, the operating lever 12 may be rotatably coupled at a lower end thereof to the above described moving guide 14 provided in the body 10. As the operating lever 12 is rotated in a first direction, an upper end of the operating lever 12 forces the pickup unit 30, causing the pickup unit 30 to be rotated. The pickup frame 34 may include an integrally formed or separately formed transmitter **34*a* as a lateral extension thereof. If the upper end of the operating lever 12 presses the transmitter 34*a*, the transmitter 34*a* acts to transmit the rotation force of the operating lever 12 to the pickup frame 34, causing the pickup frame 34** to be rotated.

The pivoting spring 13 may be, for example, a coil spring. One end of the pivoting spring 13 may be fixedly supported by the moving guide 14 whereas the other end of the pivoting spring 13 may be coupled to the operating lever 12 at a position in sufficiently away from the lower end of the operating lever 12 so as to allow the operating lever 12 to be elastically biased to rotate in the first direction.

The operating lever 12 may rotate in accordance with the coupling or separation movement of the printing medium cassette 20 with respect to the body 10. That is, the operating lever 12 may rotate in the first direction as the printing medium 20 is separated from the body 10 whereas, when the printing medium 20 moves into the body 10 on the other hand, it may rotate in a second direction opposite to the first direction.

To achieve such movements, the operating lever 12 may be provided with an integrally formed or separately coupled link **12*a*, which extends from a position in the upper half of the operating lever 12 so as to allow the operating lever 12 to be operated in linkage or otherwise in cooperation with the movement of the printing medium cassette 20. The printing medium cassette 20 may include a stopper 25 provided on a lateral surface thereof at a height corresponding to the link 12*a*. As the printing medium cassette 20 moves into the body 10, the stopper 25 catches the link 12*a*, acting to move the link 12*a*. As according to an embodiment, the operating lever 12 is located outside the moving guide 14, the link 12*a* may be provided so as to penetrate through the moving guide 14 to protrude from the inner surface of the moving guide 14 and to thereby be capable of an interfering contact with the stopper 25. The moving guide 14 may be formed with an arc-shaped guide slot 14*a*. The link 12*a* may be fitted through the guide slot 14*a* so as to be movable along a circumferential rotational path about the lower end of the operating lever 12. Accordingly, as the printing medium cassette 20 received into the body 10, the stopper 25 catches the protruding tip end of the link 12***a*, forcing the operating lever 12 via the link 12*a* to rotate in the second direction.

Hereinafter, an illustrative example of the operation of the image forming apparatus 100 according to an embodiment of the present disclosure having the above described configuration will be described with reference to the accompanying drawings.

Figure 5:
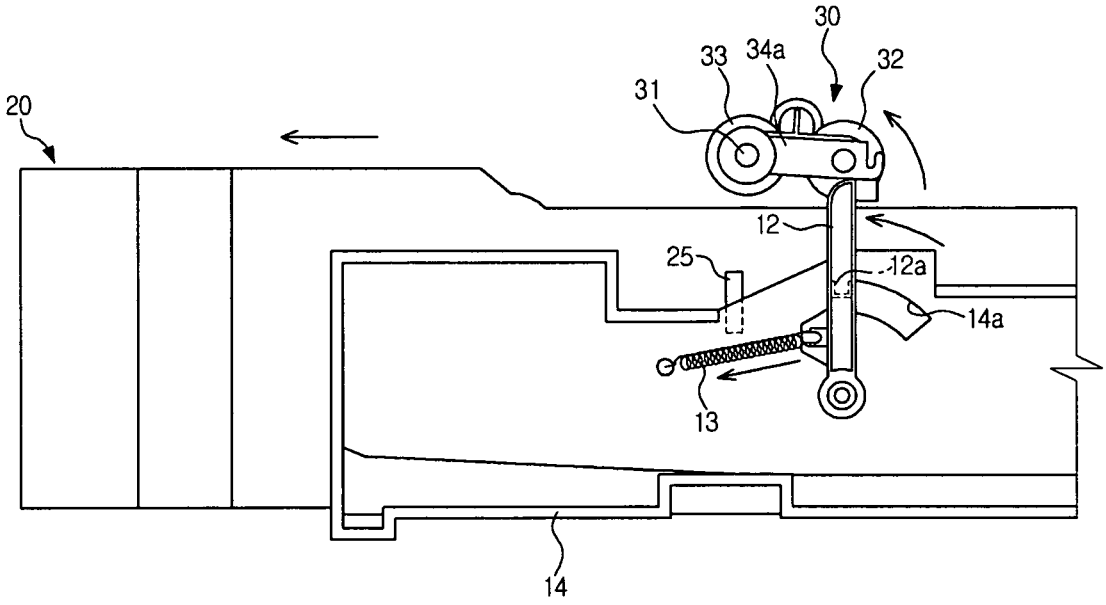
FIGS. 5 and 6 are illustrative of operations of the pickup unit during the coupling or separation of a printing medium cassette to and from an image forming apparatus according to an embodiment of the present disclosure.

Referring first to FIG. 5, when the printing medium cassette 20 moved in the direction away from the body 10 so as to be detached therefrom, the stopper 25 of the printing medium cassette 20 moves along with the printing medium cassette 20 and away from the operating lever 12 so as to release the pressing interference on the link 12*a*, allowing the operating lever 12 to be rotated in the first direction via the elastic restoration force of the pivoting spring 13.

With rotation of the operating lever 12, the upper end of the operating lever 12 comes into an interfering contact with the transmitter 34*a* of the pickup frame 34, thus allowing the elastic restoration of the pivoting spring 13 to be transmitted in part to the pickup frame 34 via the operating lever 12 and the transmitter 34*a*. As the pickup frame 34 is rotated about the pickup shaft 31 by the transmitted force, the side of the pickup frame 34 at which the pick up roller 32 is provide is moved upwardly, causing the pickup roller 32 to move according to the rotation of the pickup frame 34 upward and out of the movement path of the printing medium cassette 20, that is, the pickup roller 32 moves to a position higher than the upper end of the supporting guide 23. With the pickup roller 32 moved out of the way, the printing medium cassette 20 can continue to be removed from body 10 without the interference between the pickup roller 32 and the supporting guide 23.

Figure 6:
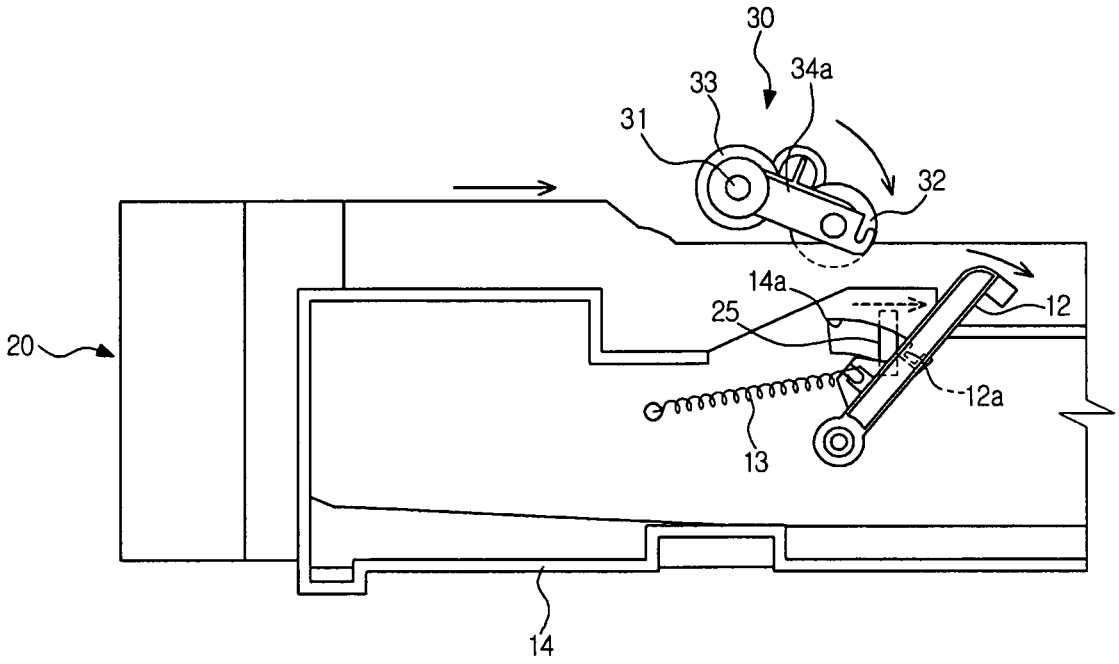

Referring to FIG. 6, when the printing medium cassette 20 moves into the body 10 to be mounted, the stopper 25 on the lateral surface of the printing medium cassette 20 comes into contact with the link 12*a*. Accordingly, the force acting on, so as to move, the printing medium cassette 20 is transmitted in part to the operating lever 12 via the stopper 25 and the link 12*a*, causing the operating lever to be rotated in the second direction opposite the first direction.

As the operating lever 12 is rotated in the second direction, the upper end of the operating lever 12 moves away from, thus becoming released from the interfering contact with, the transmitter 34*a*, resulting in no force being transmitted to the transmitter 34*a* from the operating lever 12. Accordingly, the pickup frame 34, which had been kept at the upwardly moved position by the force transmitted via the transmitter 34*a*, moves downward by the weight of the pickup frame 34 and the pickup roller 32 so that the pickup roller 32 protrudes into the movement path of the printing medium cassette 20 to thereby come into contact with the upper surface of the uppermost one of the printing media P loaded on the knock-up plate 21 so as to pick up the printing medium P.

After the printing medium cassette 20 is completely installed at the intended position in the body 10, the operating lever 12 is supported on the printing medium cassette 20 in the position rotated in the second direction by the link 12*a* and the stopper 25 as shown in FIG. 5, and can remain in such position so as to be capable of picking up the printing media P.

As is apparent from the above description, according to one or more embodiments of the present discussion, an image forming apparatus may be configured in such a manner that the pickup roller is movable in association or in cooperation of the mounting and/or detaching movements of printing medium cassette, whereby the number of printing media that can be stored in the printing medium cassette having a predetermined height may be increased.

While the disclosure has been particularly shown and described with reference to several embodiments thereof with particular details, it will be apparent to one of ordinary skill in the art that various changes may be made to these embodiments without departing from the principles and spirit of the disclosure, the scope of which is defined in the following claims and their equivalents.

What is claimed is:

1. An image forming apparatus comprising:

a body;

a printing medium cassette detachably received in the body; and a pickup unit configured pick up a printing medium from the printing medium cassette, the pickup unit including a pickup roller configured to pick up the printing medium, a delivery roller configured to deliver the picked up printing medium away from the printing medium cassette and a pickup frame to which the pickup roller and the delivery roller are rotatably coupled;

an operating lever arranged to be rotatable about one end thereof, wherein the printing medium cassette is movable along a movement path into and out of the body, the pickup unit is movable out of the movement path of the printing medium cassette in cooperation with a detaching movement of the printing medium cassette along the movement path out of the body, the movement path of the printing medium cassette is perpendicular to the axial direction of the pickup roller, and the operating lever interacts with the printing medium cassette, the operating lever making contact with the pickup unit by rotating in a first direction when the printing medium cassette is detached from the body, and is separated from the pickup unit by rotating in a second direction opposite to the first direction when the printing medium cassette is mounted on the body.

2. The image forming apparatus according to claim 1, further comprising a pivoting spring, wherein the pivoting spring elastically biases the operating lever to rotate in the first direction.

3. The image forming apparatus according to claim 2, wherein the operating lever comprises a link member arranged to come into an interfering contact with a stopper provided on the printing medium cassette, the interfering contact between the link member and the stopper allowing the operating lever to rotate in a second direction opposite the first direction according to movement of the printing medium cassette along the movement path into the body.

4. The image forming apparatus according to claim 3, wherein the pickup frame includes a transmitter in the form of an extension that receives force from the operating lever so as to cause the pickup unit to move.

5. The image forming apparatus according to claim 4, wherein the pickup unit further comprises a pickup shaft, the pickup roller being arranged to rotate about a pickup roller shaft that is parallel to the pickup shaft and being moveable circumferentially about the pickup shaft out of the movement path of the printing medium cassette.

6. The image forming apparatus according to claim 4, wherein the printing medium cassette comprises:

a knock-up plate, on which the printing medium is loaded; and a supporting guide arranged to support one end of the printing medium loaded on the knock-up plate, the pickup roller being movable to a position higher than an upper end of the supporting guide.

7. The image forming apparatus according to claim 2, further comprising a moving guide installed on at least one of opposing sides of the printing medium cassette to guide movement of the printing medium cassette along the movement path, the operating lever and the pivoting spring being arranged on the moving guide.

8. The image forming apparatus according to claim 7, wherein the moving guide has an arcuate shape guide slot, into which a portion of the operating lever is movably received.

9. An image forming apparatus comprising:

a body;

a printing medium cassette movably received in the body so as to be separable from the body via movement thereof;

a pickup unit configured to pick up a printing medium from the printing medium cassette, the pickup unit including a pickup roller configured to pick up the printing medium, a delivery roller configured to deliver the picked up printing medium away from the printing medium cassette and a pickup frame to which the pickup roller and the delivery roller are rotatably coupled;

a supporting guide arranged in the printing medium cassette to support one end of the printing medium in the printing medium cassette;

an operating lever rotatable in a first direction as the printing medium cassette moves to be separated from the body to thereby rotate the pickup unit to a position higher than an upper end of the supporting guide; and a pivoting spring configured to elastically support the operating lever to rotate in the first direction, wherein the printing medium cassette is movable along a movement path into and out of the body, the movement path of the printing medium cassette is perpendicular to the axial direction of the pickup roller, and the operating lever interacts with the printing medium cassette, the operating lever making contact with the pickup unit by rotating in the first direction when the printing medium cassette is separated from the body, and is separated from the pickup unit by rotating in a second direction opposite to the first direction when the printing medium cassette is mounted on the body.

10. The image forming apparatus according to claim 9, wherein the pickup roller is movable to a position higher than the upper end of the supporting guide according to rotational movement of the pickup unit.

11. The image forming apparatus according to claim 9, wherein the printing medium cassette has a stopper configured to interfere with the operating lever so as to cause the operating lever to rotate in a second direction opposite the first direction as the printing medium cassette moves into the body.

12. The image forming apparatus according to claim 11, wherein the operating lever has a link member adapted to come into an interfering contact with the stopper to thereby allow the operating lever to operate in linkage with the printing medium cassette.

* * * * *

UNITED STATES PATENT AND TRADEMARK OFFICE

CERTIFICATE OF CORRECTION

PATENT NO. : 8,646,771 B2
APPLICATION NO. : 12/923222
DATED : February 11, 2014
INVENTOR(S) : Youn It is certified that error appears in the above-identified patent and that said Letters Patent is hereby corrected as shown below:

In the Claims

Column 8, Line 14, In Claim 1, after “body;” delete “and”.

Signed and Sealed this
Eighth Day of July, 2014

Michelle K. Lee

Michelle K. Lee
*Deputy Director of the United States Patent and Trademark Office*